US007448891B2

(12) United States Patent
Ahn

(10) Patent No.: US 7,448,891 B2
(45) Date of Patent: Nov. 11, 2008

(54) HINGE APPARATUS AND WIRING MEMBER FOR USE IN HINGE APPARATUS

(75) Inventor: Kyoung-jin Ahn, Suwon (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1045 days.

(21) Appl. No.: 10/778,164

(22) Filed: Feb. 17, 2004

(65) Prior Publication Data

US 2004/0231105 A1 Nov. 25, 2004

(30) Foreign Application Priority Data

May 6, 2003 (KR) ..... 10-2003-0028617

(51) Int. Cl.
*H01R 3/00* (2006.01)

(52) U.S. Cl. ..... 439/165; 439/31; 361/755

(58) Field of Classification Search ..... 439/165, 439/31; 361/755
See application file for complete search history.

(56) References Cited

U.S. PATENT DOCUMENTS 6,226,448 B1 5/2001 Takagi et al.
6,275,376 B1 * 8/2001 Moon ..... 361/683
6,439,905 B2 * 8/2002 Andrews et al. ..... 439/165
6,650,547 B2 * 11/2003 Hemmi et al. ..... 361/755

FOREIGN PATENT DOCUMENTS

| | | |
|---|---|---|
| CN | 1251927 A | 7/1999 |
| JP | 58-54194 | 4/1983 |
| JP | 05-252245 | 9/1993 |
| JP | 10-290084 | 10/1998 |
| JP | 2001-044669 | 2/2001 |
| JP | 2002-354086 | 12/2002 |

* cited by examiner

*Primary Examiner*—Tho D Ta
(74) *Attorney, Agent, or Firm*—Roylance, Abrams, Berdo & Goodman, L.L.P.

(57) ABSTRACT

A hinge apparatus, which includes a first hinge part connected, in a rotatable manner, to a first electronic apparatus, a second hinge part having a second hinge axis connected in an inclined manner at a predetermined angle to a first hinge axis of the first hinge part, a wiring member for connecting the first and the second electronic apparatus by sequentially passing by the first and the second hinge axes in a manner of winding around the outer peripheral surfaces of each of the first and the second hinge axes. Accordingly, the hinge apparatus can connect a plurality of electronic apparatus so that those electronic apparatus are mutually rotatable in a plurality of rotational directions without implementing the complicated manufacturing process of forming through holes on each of the hinge axes, and inserting the wiring member into those through holes.

26 Claims, 6 Drawing Sheets

HINGE APPARATUS AND WIRING MEMBER FOR USE IN HINGE APPARATUS

CROSS-REFERENCE TO RELATED APPLICATIONS

This application claims the benefit of Korean Patent Application No. 2003-28617 filed May 6, 2003, in the Korean Intellectual Property Office, the disclosure of which is incorporated herein by reference.

BACKGROUND OF THE INVENTION

1. Field of the Invention

The present invention relates to a hinge apparatus. More particularly, the present invention relates to a hinge apparatus for connecting a plurality of electronic apparatus in a plurality of rotational directions so that those electronic apparatus can be rotated relative to each other, and a wiring member adopted to the hinge apparatus.

2. Description of the Related Art

Generally, a separately prepared small-sized electronic apparatus such as a display unit is connected, in a rotatable manner, to portable electronic apparatus that can be carried and used by a user such as a photographing apparatus, a cellular phone, a personal digital assistant (PDA), a notebook computer, a portable audio/video playing apparatus, among other devices. The display unit includes a display panel such as an liquid crystal display (LCD) for use in video playing, and the display unit is connected, in a rotatable manner in at least one direction, to the portable apparatus body by means of a hinge apparatus. The rotatable connection is provided so that a user can watch an image played on the display panel when the portable electronic apparatus is positioned in a variety of postures.

FIG. 1 is an exemplary illustration of a composite photographing apparatus 100 which is used both for a camcorder and a digital still camera in which a display unit 120 is installed in a rotatable manner as an example of the portable electronic apparatus described above.

Referring to FIG. 1, the photographing apparatus 100 includes a portable apparatus body 110 and a display unit 120 connected in a rotatable manner, to one side of the portable apparatus body 110, by a hinge apparatus 130. The portable apparatus body 110 includes an optical unit 113, for photographing an object and an operating button 115. The display unit 120 includes a display operating part 122 (refer to FIG. 3) and a casing 125 for enclosing the outline of the display operating part 122. The display operating part 122 has a display panel 123 for playing an image, and an operating board 126 (refer to FIG. 3).

FIG. 2 is an exemplary illustration of a conventional hinge apparatus for connecting the display unit 120 to the portable apparatus body 110, so that the display unit 120 can be rotated around two axes X, Y as a center of rotation.

Referring to FIG. 2, the conventional hinge apparatus 130 includes the first hinge part 131 that is connected, in a rotatable manner, to one side of the portable apparatus body 110 (refer to FIG. 1), a second hinge part 135 that is fixed in one side of the display unit 120 (refer to FIG. 1) and is connected, in a rotatable manner, to the first hinge part 131. Additionally, a connector 141 is separately provided to an end of a wiring member 140 to connect with the display operating part 122 of the display unit 120.

The first hinge part 131 connects the display unit 120 to the portable apparatus body 110 in a rotatable manner so that they can be rotated in a first and the second rotational directions (a, b) that open and close around the X-axis as a center of rotation. The X-axis extends along the primary axis of the first hinge axis 132. The second hinge part 135 connects the display unit 120 to the portable apparatus body 110 in a rotatable manner so that they can also be rotated in a third and fourth rotational directions (c, d) around the Y-axis as a center of rotation. The Y-axis extends along the primary axis of the second hinge axis 136. The display unit 120 can be rotated to a predetermined angle in an opening direction (a) from a closed position in which the display unit 120 was received in a reception part 117. Generally, the hinge axes 132, 136 are so arranged that such X-axis and Y-axis are substantially perpendicular to each other.

A conventional hinge apparatus 130 having the foregoing construction makes the display unit 120 rotatable in a plurality of directions with respect to the portable apparatus body 110. Therefore, a user can conveniently watch an image played on the display panel 123 even when using the photographing apparatus 100 positioned in various postures. Also, the conventional hinge apparatus 130 prevents the wiring member 140 from being exposed to the outside of the photographing apparatus 100, by inserting the wire-shaped wiring member 140 into the through holes 132*a*, 136*a* of the first and the second hinge axes 132, 136. Therefore, appearance of the photographing apparatus 100 becomes neat and clean and destruction of the wiring member 140, which could be generated when the wiring member 140 is exposed to the outside, is prevented.

In such a conventional hinge apparatus 130, however, there exists an inconvenience in that the through holes 132*a*, 136*a* should be formed on the first and the second hinge axes 132, 136, respectively, in order to connect the display unit 12 to the portable apparatus body 110 so that signal transfer may be mutually possible. Further, the wire-shaped wiring member 140 should be inserted into those through holes 132*a*, 136*a*.

As the amount of information exchanged through the wiring member 140 between the display unit 120 and the portable apparatus body 110 increases, however, the portable apparatus 100 is required to have a sufficiently thick wiring member 140 and a large connector 141. Therefore, the manufacturing process of the portable apparatus 100 becomes cumbersome and, accordingly, it becomes difficult to provide a compact portable electronic apparatus. Also, the larger the rotational range of the display unit 120 is set, the greater the possibility that the wire-shaped wiring member 140 can be destroyed. Therefore, it is not easy to extend the rotational range of the display unit 120.

SUMMARY OF THE INVENTION

In an effort to solve the problems as described above, it is an aspect of the present invention to provide a wiring member for electrically coupling a first and second electronic apparatus together, wherein the first and second electronic apparatus comprises a portable apparatus body and a display unit, respectively, and the first and second electronic apparatus are connected by a hinge apparatus. The hinge apparatus comprises a first hinge part connected, in a rotatable manner, to the first electronic apparatus and a second hinge part having a second hinge axis connected at a predetermined angle to a first hinge axis of the first hinge part. The wiring member comprises a first winding part for winding around an outer peripheral surface of the first hinge axis, a second winding part for winding around an outer peripheral surface of the second hinge axis and a connecting part for connecting the first and the second winding parts, to each other.

It is another object of the invention to provide a hinge apparatus comprising a first hinge part connected, in a rotatable manner, to a first electronic apparatus and a second hinge part having a second hinge axis connected at a predetermined angle to a first hinge axis of the first hinge part. It is still a further object of the invention to provide a wiring member for connecting the first and the second electronic apparatus by sequentially passing by the first and the second hinge axes in a manner of winding around the outer peripheral surfaces of each of the first and the second hinge axes.

BRIEF DESCRIPTION OF THE DRAWINGS

The above objects and other advantages of the present invention will be more apparent from the following detailed description when taken in conjunction with the accompanying drawings, in which.

DETAILED DESCRIPTION OF THE PREFERRED EMBODIMENTS

Certain embodiments of the present invention will now be described with reference to the accompanying drawings.

Figure 1:
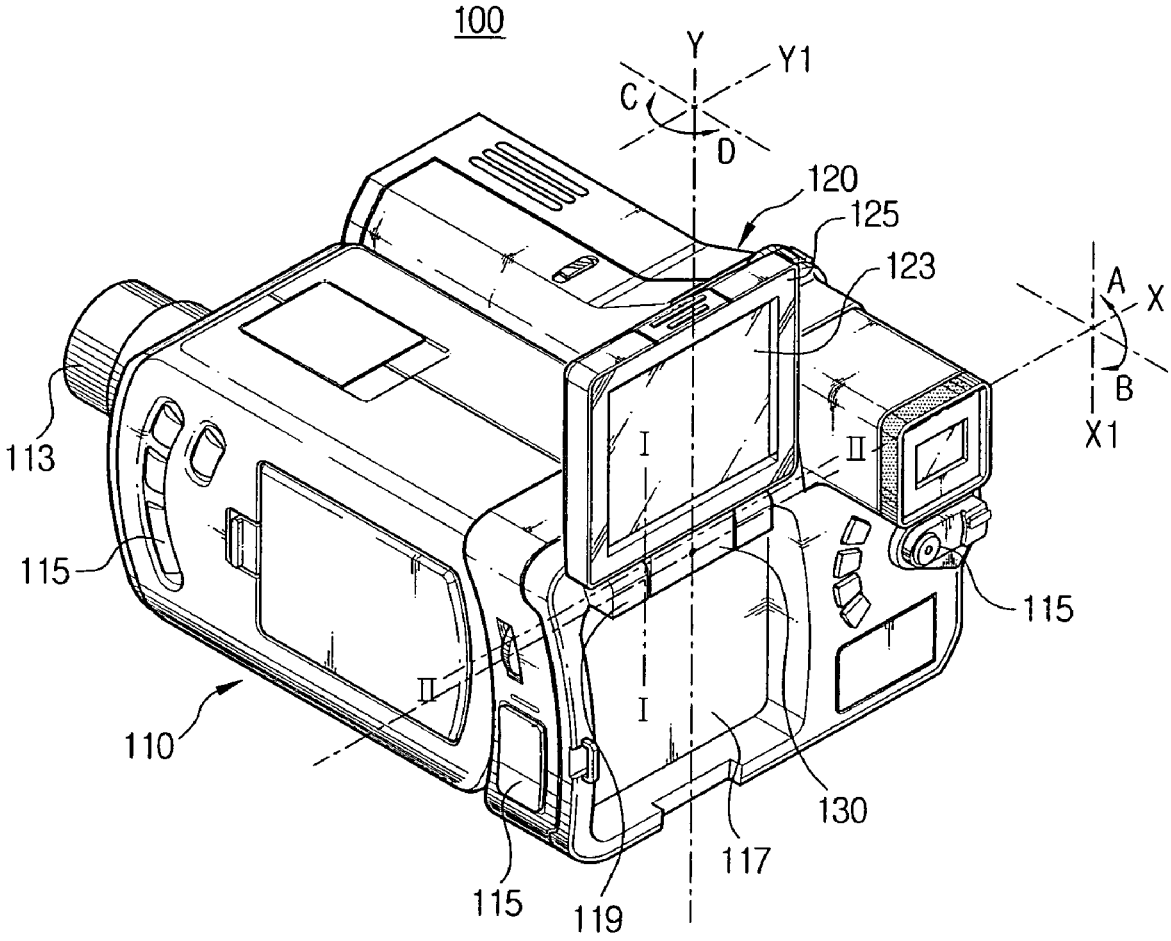
FIG. 1 is a perspective view of a portable photographing apparatus, which is an example of the general portable electronic apparatus.
Figure 2:
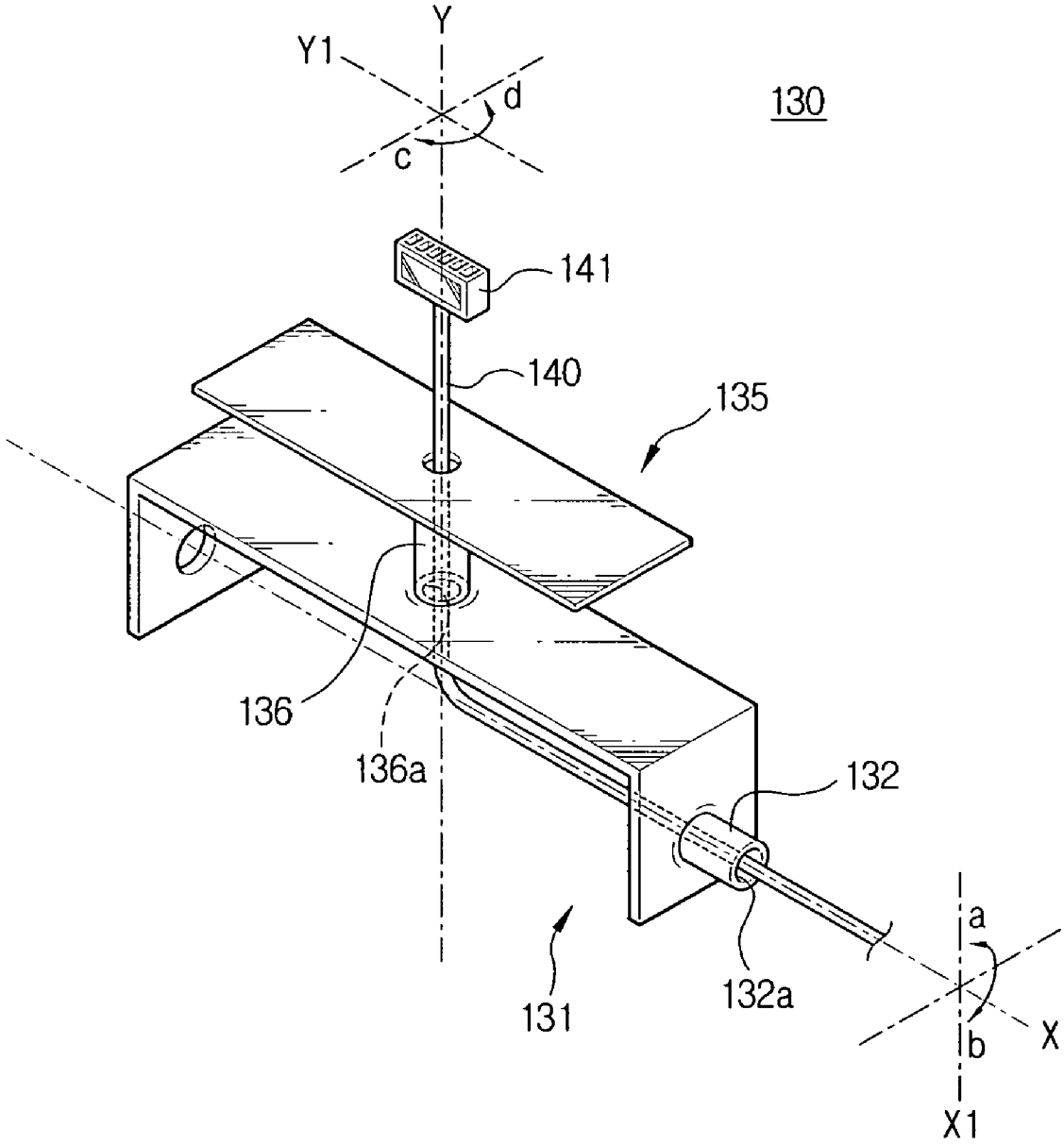
FIG. 2 (PRIOR ART)
FIG. 2 is a perspective view illustrating an inner structure of a hinge apparatus for use in a display unit of the portable electronic apparatus shown in FIG. 1.

In the description of the embodiment of the present invention, same drawing reference numerals are used for the elements having the same construction and function as the elements of the conventional portable electronic apparatus shown and described in FIG. 1 and FIG. 2, and description thereof will be omitted. The matters defined in the description such as a detailed construction and elements are nothing but the ones provided to assist in a comprehensive understanding of the invention. Thus, it is apparent that the present invention can be carried out without those defined matters.

In an embodiment of the present invention, the hinge apparatus connects different first and second electronic apparatuses so that those electronic apparatus are rotatable in a first and second rotational directions that are mutually inclined with respect to each other. Through use of the hinge apparatus, the first and second electronic apparatuses are capable of transferring electrical signals between them.

Figure 3:
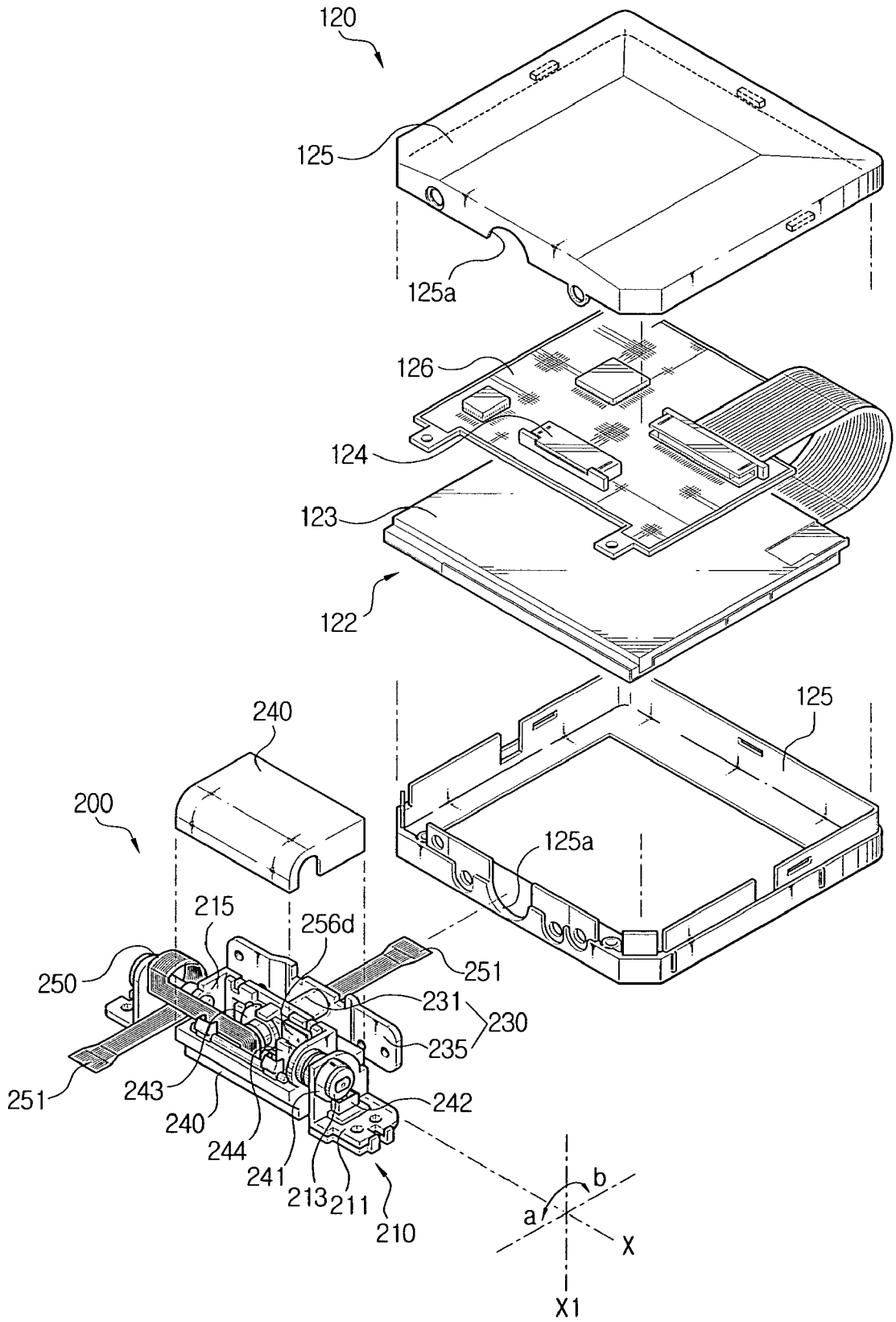
FIG. 3 is a perspective view illustrating a display unit of the portable electronic apparatus and an inner structure of a hinge apparatus for use in a display unit according to an embodiment of the present invention.
Figure 4:
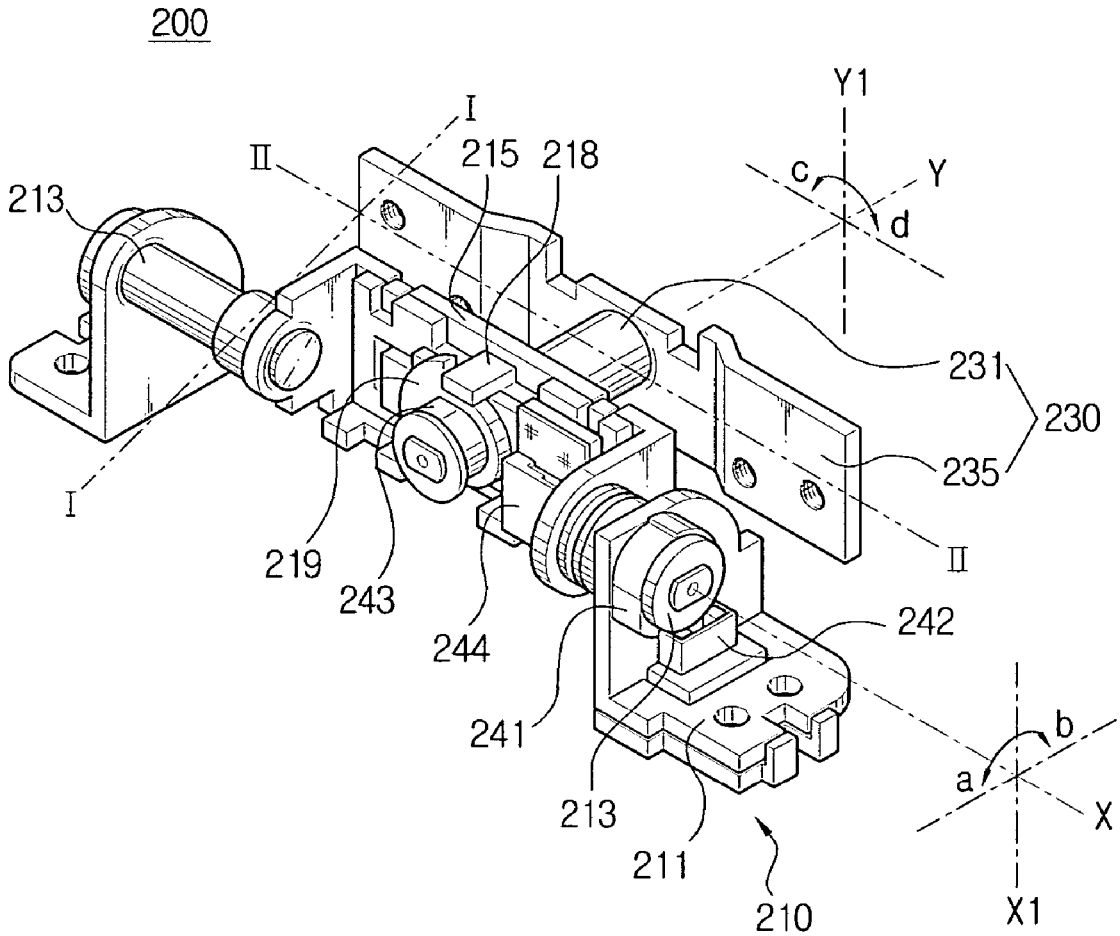
FIG. 4 is an expanded, perspective view of the hinge apparatus shown in FIG. 3.

FIGS. 3 and 4 illustrate a hinge apparatus 200 for connecting the display unit 120 with the portable apparatus body 110 (shown in FIG. 1) so that they are mutually rotatable, in accordance with an embodiment of the present invention. As described below, the portable apparatus body 110 will be taken as an example for the first electronic apparatus, and the display unit 120 will be taken as an example for the second electronic apparatus for better understanding of the embodiments of present invention.

Referring to FIGS. 3 and 4, the hinge apparatus 200 according to the preferred embodiment of the present invention includes a first hinge part 210, a second hinge part 230, a wiring member 250 and a casing 240. The reference numerals 241, 242, 243, 244 represent a first protuberance, a first detecting sensor, a second protuberance, and a second detecting sensor, respectively. Those elements are used to output a detecting signal to indicate the posture of the display unit 120, when the display unit 120 is positioned in a predetermined posture by rotating it with respect to the portable apparatus body 110. The display unit 120 can be rotated so that an image displayed through the display panel 123 can be turned over upside down, if necessary, in response to the posture of the display unit 120. As turning over of an image using the described elements is well known to those skilled in the art, detailed description of the construction and functions thereof will be omitted.

The first hinge part 210 supports the display unit 120 in a rotatable manner in the first and the second directions (a, b) to which the display unit 120 is opened and closed. The first hinge part 210 includes a first fixing member 211 fixed on the inside of the portable apparatus body 110, a first hinge axis 213 installed in a rotatable manner with respect to the first and the second directions (a, b), at the first fixing member 211, and a first rotating member 215 extended from the first hinge axis 213. For reference, the first and the second directions (a, b) in an embodiment of the present invention have, as a center of rotation, a virtual X-axis extended along the primary axis of the first hinge axis 213. The second hinge part 230 is used to rotate the display unit 120 in the third and fourth directions (c, d), that are inclined according to some known angle with respect to the rotational direction of the first hinge axis 213 after the display unit 120 is detached from the reception part 117 (refer to FIG. 1). In order to rotate the display unit 120 in this manner, the second hinge part 230 includes a second hinge axis 231, installed on the first rotating member 215, such that the second hinge axis 231 can rotate in the third and the fourth directions (c, d), and a second fixing member 235 for connecting the display unit 120 with the second hinge axis 231. For reference, the third and the fourth directions (c, d) in an embodiment of the present invention have, as a center of rotation, a virtual Y-axis extended along the primary axis of the second hinge axis 231. The X-axis and Y-axis are preferably perpendicular or substantially perpendicular to each other.

The wiring member 250 connects the display unit 120 with the portable apparatus 110 so that electrical signals can be transferred between them. The wiring member 250 extends from the display unit 120 up to the portable apparatus body 110 by first passing by the second hinge axis 231 and then the first hinge axis 213.

The casing 240 encloses the first and the second hinge parts 210, 230 and the portion of wiring member 250 exposed between the display unit 120 and the portable apparatus body 110 with the display unit 120 connected to the portable apparatus body 110.

The hinge apparatus 200 according to an embodiment of the present invention having such construction is characterized in that the wiring member 250 connects the display unit 120 with the portable apparatus body 110 by winding around the outer peripheral surfaces of the first and the second hinge axes 213, 231 a predetermined number of times, without passing through the first and the second hinge axes 213, 231.

The hinge apparatus 200 preferably incorporates a printed metal pattern in its inside so that the above-mentioned electrical signal transfer can occur. The hinge apparatus 200 also has, on both its ends, integrally formed connectors 251 connected to the first and the second connectors 110*b*, 124 (shown in FIG. 5) of the portable apparatus body 110 and the display operating part 122. The hinge apparatus 200 uses a flexible printed circuit (FPC) that can be freely bent for the wiring member 250. Both ends of the wiring member 250 extends from the inside of the casing 240 to the respective inside of the display unit 120 and the portable apparatus body 110. The wiring member 250 passes through a connecting hole 125*a* formed on the casing 125 of the display unit 120, and a connecting hole (not shown) prepared on the connecting part 119 (refer to FIG. 1) of the portable apparatus body 110., Since the casing 240 encloses the outline of the hinge apparatus 200 exposed between the display unit 120 and the portable apparatus body 110, as described above, the wiring member 250 is not exposed to the outside of the photographing apparatus 100 (refer to FIG. 1).

Figure 5:
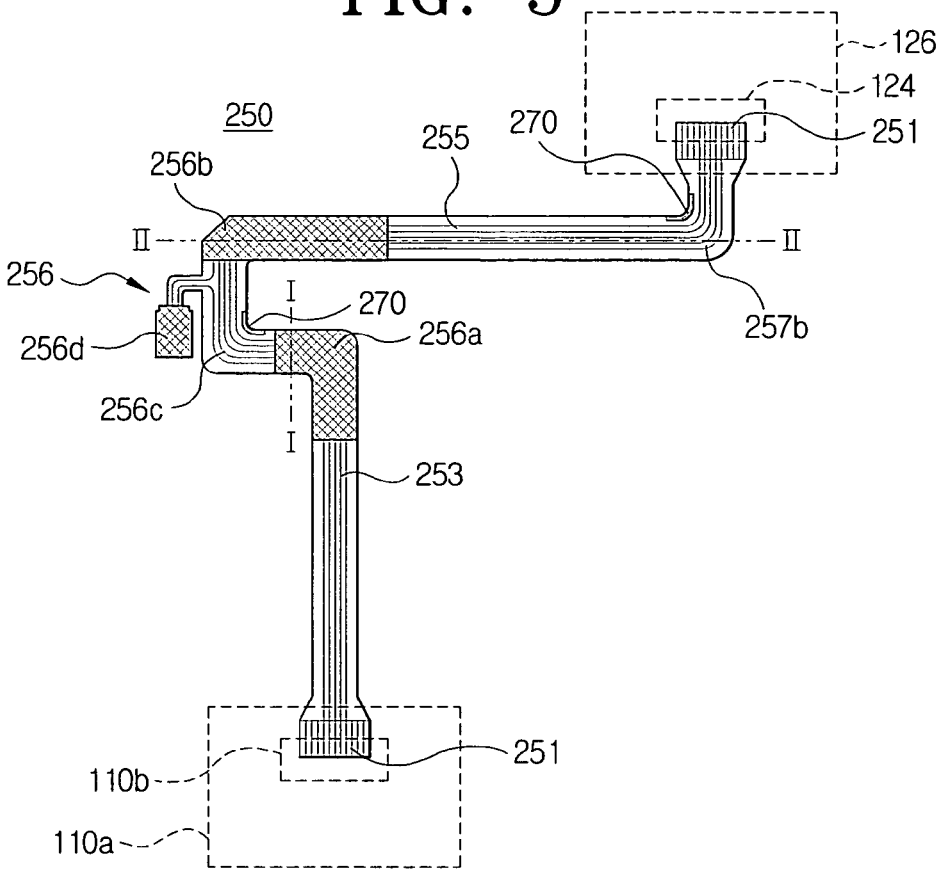
FIG. 5 is plan view illustrating a pre-fabricated state of a wiring member according to a first embodiment of the present invention.
Figure 6:
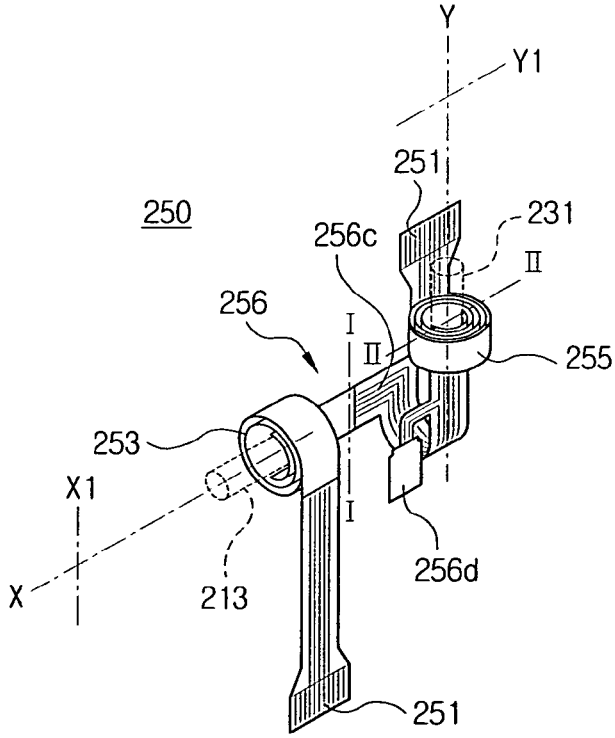
FIG. 6 is a perspective view illustrating a partially fabricated state of the wiring member of FIG. 5 as it is mounted on the hinge apparatus.

FIGS. 5 and 6 show the wiring member 250 according to a first embodiment of the present invention. Referring to FIGS. 5 and 6, the wiring member 250 according to a first embodiment of the present invention includes a first winding part 253, for winding around an outer peripheral surface of the first hinge axis 213, a second winding part 255 for winding around an outer peripheral surface of the second hinge axis 231, and a connecting part 256 for connecting the first and the second winding parts 253, 255 in an inclined manner. The wiring member 250 further includes connectors 251 for connecting to the first and the second connectors 110*b*, 124 of the first and the second boards 110*a*, 126 respectively mounted on the inside of the portable apparatus body 110 and the display unit 120. The connecting part 256 has a first corner part 256*a* for connecting to the first winding part 253 on its one end and has a second corner part 256*b* for connecting to the second winding part 255 on its other end. The connecting part 256 also includes a fifth corner part 256*c* for connecting the first and the second corner parts 256*a*, 256*b* in an inclined manner. The fifth corner part 256*c* can be omitted depending on the shape of the wiring member 250. Third connector 256*d* is located on one side of the connecting part 256 between the first and the second corner parts 256*a*, 256*b* so that the third connector 256*d* can be connected to a first detecting sensor 244 (shown in FIG. 3). The first detecting sensor 244 is a part of a turning-over unit, for turning over, upside down, an image displayed on the display unit 120, depending on the posture of the display unit 120.

FIG. 6 is a perspective view illustrating a partially fabricated state of the wiring member 250 of FIG. 5 as it is mounted on the hinge apparatus 200. A portion of the wiring member 250 is coated with a known coating material. This coating material prevents the wiring member 250 from being damaged or degraded by contact with the portable apparatus body 110, the casing 240, and the display unit 120, as the display unit 120 is rotated from the first through the fourth rotational directions (a~d) with respect to the portable apparatus body 110. The portions of the wiring member 250 that are positioned inside the gaps (I-I, II-II) between the portable apparatus body 110, the casing 240, and the display unit 120, are difficult to observe from the outside of the portable apparatus 100. A black film made of resin is preferably used for the coating material.

The hinge apparatus 200 is preferably configured so that the display unit 120 can be rotated in the first through the fourth rotational directions (a~d) within a predetermined angle with respect to the portable apparatus body 110. Restricting rotation to specific predetermined angles prevents the wiring member 250 from being twisted and spoiled due to excessive rotation or infinite rotation of the display unit 120 in one direction. Therefore, the rotational range of the display unit 120 by the hinge apparatus 200 with respect to the portable apparatus body 110 is determined by a restricting means.

Referring to FIG. 4 again, the rotational range of the display unit 120 according to an embodiment of the present invention is restricted by the hinge apparatus 200 so that the display unit 120 can be rotated up to or about 180° in a first rotational direction (a) as shown in FIG. 1. First rotational direction (a) rotates the display unit 120 from its storage position in the reception part 117 to the position as shown in FIG. 1 (fully open position) again rotated up to or about 180° along the third rotational direction (c). The rotational range restriction for the first and the second rotational directions (a, b) is determined by contact of the display unit 120 with the reception part 117 and a part of the portable apparatus body 110, positioned on the upper end of the reception part 117. The rotational range restriction for the third and the fourth rotational directions (c,d) is determined by contact of the first protuberance 218 (shown in FIG. 4) prepared on the first hinge part 210, and the second protuberance 219 prepared on the second hinge axis 231.

The rotational range restriction of the display unit 120 determines the minimum lengths of the first and the second winding parts 253, 255 for winding around the first and the second hinge axes 213, 231, respectively. As the rotational range of the display unit 120 increases the minimum lengths of the first and the second winding parts 253, 255 also increases. This prevents the wiring member 250 from being damaged or degraded by winding/unwinding of the first and the second winding parts 253, 255 upon rotation of the display unit 120. Since the display unit 120 is restricted from rotating beyond about 180° in the first through the fourth rotational directions (a~d), respectively, the first and the second winding parts 253, 255 are formed of such a length that the wiring member 250 can wind around the first and the second hinge axes 213, 231 more than about 1.5 times. Therefore, twisting of, and subsequent damage to, of the wiring member 250 can be prevented while the display unit 120 rotates in the first through the fourth rotational directions (a~d) with respect to the portable apparatus body 110.

If winding parts 253, 255 are formed in such a length that they can wind around each of the hinge axes 213, 231 several times, rotation of the display unit 120 is easily performed and space for winding/unwinding is minimized. The length of the respective winding part 253, 255, however, cannot be made infinitely long, as the volume of the hinge apparatus 200 would become large due to the thickness of the winding parts 253, 255 enclosing the hinge axes 213, 231. It would then be difficult to provide the compact electronic apparatus (i.e., photographing apparatus 100) if the lengths of the winding parts 253, 255 are formed unnecessarily long. Therefore, the lengths of the first and the second winding parts 253, 255 should be appropriately adjusted within such a range that the volume of the hinge apparatus 200 can be minimized in agreement with the predetermined rotational range, and that the winding parts 253, 255 cannot be damaged or degraded upon rotation of the display unit 120. This is particularly so in the case of the second winding part 255 as it is wound around the second hinge axis 231, which is arranged in a space narrower than the first hinge axis 213. In view of these concerns, the second winding part 255 is formed in a length that can wind around the second hinge axis 231 about 3.5 times. When constructed in this manner, damage to the wiring member 250 is prevented upon rotation of the display unit 120 and the volume occupied by the second winding part 255 for winding or unwinding around the outer peripheral surface of the second hinge axis 231 is minimized as well.

Referring back to FIGS. 5 and 6 again, the connectors 251, which connects the wiring member 250 to the first and the second connectors 110*b*, 124 of the first and the second boards 110*a*, 126, are provided, respectively, at the side of the portable apparatus body 110, in the first winding part 253, and the end at the side of the display unit 120, in the second winding part 255. The positions of the first and second connectors 10*b*, 124 change the whole shape of the wiring member 250. As shown in FIGS. 5 and 6, in the case that the first connector 110*b* is arranged on a virtual first axis (X1-axis) perpendicular to the primary axis (X-axis) of the first hinge axis 213, the connector 251 is directly arranged on the end of the first winding part 253. In the case that the second connector 124 is arranged on the Y-axis of the second hinge axis 255, the connector 251 is connected to the second winding part 255 in an inclined manner by the fourth corner part 257*b*.

Preferably, the wiring member 250 having such construction additionally includes a predetermined reinforcing member 270. The reinforcing member 270 prevents the fourth corner part 257*b* from being torn out upon exertion of a shearing stress on the fourth corner part 257*b* as the second winding part 255 winds around the second hinge axis 231. In the embodiment of the present invention described above, the reinforcing member 270 is installed in the inside of the fourth corner part 257*b*, and is provided in the form of a metal pattern installed regardless of signal exchange between the first and the second boards 110*a*, 126. As one skilled in the art can appreciate, any type of reinforcing member whatsoever can be used to prevent shearing stress form tearing the fourth corner part 257*b*.

Figure 7:
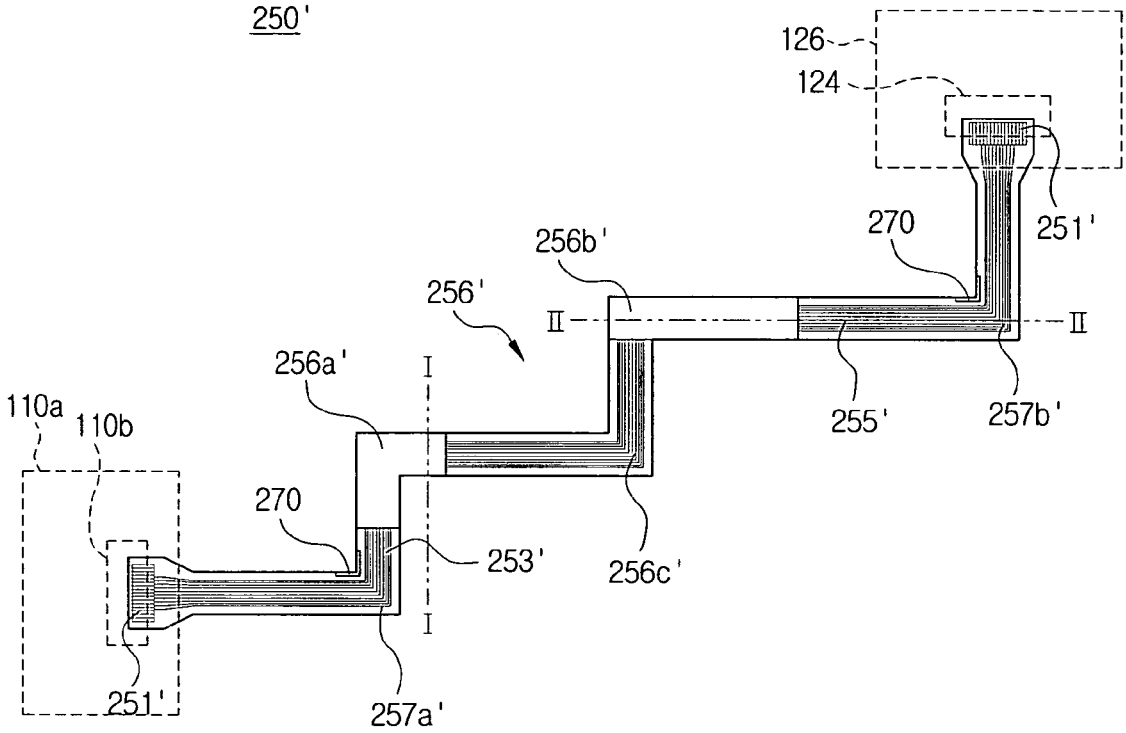
FIG. 7 is a plan view illustrating a pre-fabricated state of the wiring member according to a second embodiment of the present invention.
Figure 8:
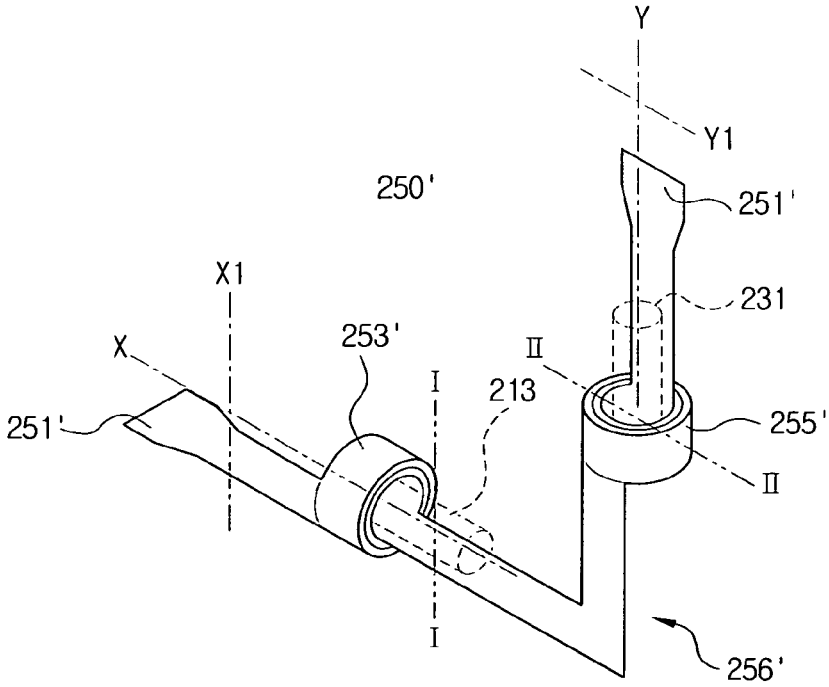
FIG. 8 is a perspective view illustrating a partially fabricated state of the wiring member of FIG. 6 as it is mounted on the hinge apparatus.

FIGS. 7 and 8 illustrate a wiring member 250' according to a second embodiment of the present invention. Referring to FIGS. 7 and 8, the wiring member 250' of the second embodiment is similar to the first embodiment in that the wiring member 250' has the first and the second winding parts 253', 255' and the connecting part 256'. The shapes and position of each part of the first and the second winding parts 253', 255', however, are different for the first and the second winding parts 253', 255' in that their lengths differ from their respective components described in the first embodiment of the present invention. The first and the second winding parts 253', 255' can be formed in such lengths that can wind around the first and the second hinge axes 213, 231 more than 1.5 times.

According to the second embodiment of the present invention, the first connector 110*b* is arranged in the direction of the primary axis of the first hinge axis 213. Therefore, the wiring member 250' according to the second embodiment of the present invention additionally includes the third corner part 257*a*'. A metal pattern 270 is installed as a reinforcing member on the third corner part 257*a*' in order to prevent the third corner part 257*a*' from being damaged or degraded due to shearing stress as in the case of the fourth corner part 257*b* of the first embodiment of the present invention, described above. The shapes of the third and the fourth corner parts 257*b*' can change in various ways depending on the positions of the first and the second connectors 100*b*, 124.

In the above description the hinge apparatus has been described for use only in the composite photographing apparatus 100 which is both a camcorder and a digital still camera. The hinge apparatus can be used in the display unit of the portable apparatus. The description of the present invention, however, is not necessarily limited to that specific case. For example, the present invention can also be readily applied to other kinds of portable electronic apparatus that includes a display unit rotatable in a plurality of directions, such as a portable phone, a PDA, a notebook computer, and other portable electronic devices.

A hinge apparatus and wiring member constructed in accordance with the embodiments of the present invention as described above, can connect the display unit 120 with the portable apparatus body 110 so that the wiring member 250, 250' is not exposed to the outside. This accomplished without even requiring the complicated process of forming through holes on a central portion of each hinge axis, and inserting the wiring member 250, 250' into those through holes.

As FPC is used for the wiring member 250, 250', the particular problem of the prior art that the connector should be separately installed on the end of the wiring member is resolved and the rotational range of the display unit can be extended without damaging of the wiring member.

While the invention has been shown and described with reference to certain preferred embodiments thereof, it is apparent that the present invention is not limited to those constructions and operations as they are, and it will be understood by those skilled in the art that various changes in form and details may be made therein without departing from the spirit and scope of the invention as defined by the appended claims. Therefore, all such proper modifications, changes and equivalents of the embodiments of the present invention will fall within the scope of the invention.

What is claimed is:

1. A wiring member for electrically coupling a first and second electronic apparatus together, the first and second electronic apparatus comprising a portable apparatus body and a display unit, respectively, wherein the first and second electronic apparatus are connected by a hinge apparatus, the hinge apparatus comprising a first hinge part having a first hinge axis connected, in a rotatable manner, to the first electronic apparatus, a second hinge part having a second hinge axis connected at a predetermined angle to a first hinge axis of the first hinge part, wherein the wiring member comprising:

a first linear winding part, for winding around an outer peripheral surface of the first hinge axis, the first linear winding part having a first end with a connector and a second end;

a second linear winding part for winding around an outer peripheral surface of the second hinge axis, the second linear winding part having a first end and a second end; and a connecting part having a first portion connected to the first winding part and a second portion connected to the second winding part, and where said first and second portions are perpendicular to each other.

2. The wiring member according to claim 1, further comprising:

the first wiring member connector connected to the first winding part for connecting to a first connector of a first board mounted on an inside portion of the portable apparatus body; and a second wiring member connector connected to the second winding part for connecting to a second connector of a second board mounted on an inside portion of the display unit.

3. The wiring member according to claim 1, wherein the connecting part further comprises:

a third connector located on one side of the connecting part between the first and the second corner parts and adapted for connecting to a first detecting sensor of a turning-over unit for turning the display unit.

4. The wiring member according to claim 1, further comprising:

a coating material on a portion of the wiring member for protecting the wiring member from being damaged by contact with the portable apparatus body as the display unit is rotated through at least one or more rotational directions with respect to the portable apparatus body.

5. The wiring member according to claim 1, wherein:

the first and second winding parts have a length to wind around the first and second hinge axes at least 1.5 times.

6. The wiring member according to claim 1, wherein:

the second winding part has a length to wind around the second hinge axis at least 3.5 times.

7. The wiring member according to claim 1, further comprising:

a fourth corner part at the first end of the second winding part; and a reinforcing member on an inside edge of the fourth corner part for preventing the fourth corner part from being damaged upon exertion of a shearing stress on the fourth corner part as the second winding part winds around the second hinge axis.

8. The wiring member according to claim 1, wherein:

the first portion of the connecting part defines a first corner part connected to the first winding part on the first end; and the second portion of the connecting part defines a second corner part connected to the second winding part on the second end.

9. The wiring member according to claim 8, wherein the first and second portions of the connecting part define a fifth corner part for connecting the first and the second corner parts together.

10. The wiring member according to claim 1, further comprising:

the first wiring member connector connected to the first winding part for connecting to a first connector of a first board mounted on an inside portion of the portable apparatus body;

a second wiring member connector connected to the second winding part for connecting to a second connector of a second board mounted on an inside portion of the display unit; and a third corner part for aligning the first wiring member connector in the direction of a primary axis of the first hinge axis and for aligning the second wiring member connector to a direction of the second hinge axis.

11. The wiring member according to claim 10, further comprising:

a metal reinforcing member on an inside edge of the third corner part for preventing the third corner part from being damaged upon exertion of a shearing stress on the third corner part as the second winding part winds around the second hinge axis.

12. A hinge apparatus comprising:

a first hinge part connected, in a rotatable manner, to a first electronic apparatus, a second hinge part having a second hinge axis connected at a predetermined angle to a first hinge axis of the first hinge part; and a wiring member for connecting the first and the second electronic apparatus by sequentially passing by the first and the second hinge axes in a manner of winding around the outer peripheral surfaces of each of the first and the second hinge axes, wherein the wiring member includes:

a first linear winding part wound around the first hinge axis of the first hinge part and having a first end with a connector and a second end, a second linear winding part wound around the second hinge axis of the second hinge part and having a first end with a connector and second end, and a connecting part having a first portion connected to the first winding part and a second portion connected to the second winding part and where the first and second portions are perpendicular to each other.

13. The hinge apparatus according to claim 12, wherein:

the first wiring member connector connected to the first winding part is connected to a first connector of a first board mounted on an inside portion of the first electronic apparatus; and a second wiring member connector connected to the second winding part is connected to a second connector of a second board mounted on an inside portion of the second electronic apparatus.

14. The hinge apparatus according to claim 12, further comprising:

a coating material to coat a portion of the wiring member for preventing the wiring member from being damaged or degraded by contact with the first electronic apparatus and the second electronic apparatus, as the second electronic apparatus is rotated through at least one or more rotational directions with respect to the portable apparatus body.

15. The hinge apparatus according to claim 12, wherein:

the first and second winding parts have a length to wind around the first and second hinge axes at least 1.5 times.

16. The hinge apparatus according to claim 12, wherein:

the second winding part such has a length to wind around the second hinge axis at least 3.5 times.

17. The hinge apparatus according to claim 12, further comprising:

a fourth corner part; and a reinforcing member installed in the inside edge of the fourth corner part for preventing the fourth corner part from being torn out upon exertion of a shearing stress on the fourth corner part as the second winding part winds around the second hinge axis, and is provided in the form of a metal pattern.

18. The hinge apparatus according to claim 12, wherein the connecting part comprises:

a first corner part for connecting to the first winding part on a first end; and a second corner part for connecting to the second winding part on a second end.

19. The hinge apparatus according to claim 18, wherein the connecting part further comprises:

a fifth corner part for connecting the first and the second corner parts, in an inclined manner.

20. The hinge apparatus according to claim 18, wherein the first and second electronic apparatus comprise a portable apparatus body and a display unit, respectively, and the connecting part further comprises:

a third connector located on one side of the connecting part between the first and the second corner parts so that the third connector can be connected to a first detecting sensor that is part of a turning-over unit for turning over, upside down, an image displayed on the display unit.

21. The hinge apparatus according to claim 12, wherein:

the first wiring member connector connected to the first winding part is connected to a first connector of a first board mounted on an inside portion of the portable apparatus body;

a second wiring member connector connected to the second winding part is connected to a second connector of a second board mounted on an inside portion of the display unit; and a third corner part for aligning the first wiring member connector in the direction of the primary axis of the first hinge axis.

22. The hinge apparatus according to claim 21, wherein:

a metal reinforcement member is provided on an inside edge of the third corner part for preventing the third corner part from being torn out upon exertion of a shearing stress on the third corner part as the second winding part winds around the second hinge axis.

23. A hinge apparatus comprising:

a first hinge part rotatably connected to a first electronic apparatus and being pivotable about a first axis, and a second hinge part rotatably connected to a second electronic apparatus and to the first hinge part, the second hinge part being pivotable about a second axis that is substantially perpendicular to the first axis; and a wiring member for connecting the first and the second electronic apparatus by sequentially winding around the outer peripheral surfaces of each of the first and the second hinge axes, wherein the wiring member includes:

a first linear winding part wound around the first hinge axis of the first hinge part and having a first end and a second end, a second linear winding part wound around the second hinge axis of the second hinge part and having a first end and second end, and a connecting part having a first portion connected to the second end of the first winding part and a second portion connected to the second end of the second winding part, and where the connecting part is fixed to the hinge apparatus.

24. The hinge apparatus of claim 23, wherein the connecting part is fixed to the first hinge part.

25. The hinge apparatus of claim 23, wherein the connecting part includes an electrical connector.

26. The hinge apparatus of claim 25, wherein the connector on the connecting port is connected to a detector sensor to detect the position of the apparatus.

* * * * *